US005671852A

United States Patent [19]

Maharg

[11] Patent Number: 5,671,852

[45] **Date of Patent: *Sep. 30, 1997**

[54] DISPLAY AND DECORATIVE FIXTURE APPARATUS

[75] Inventor: James C. Maharg, Ridgefield, Conn.

[73] Assignee: Alu Inc., New York, N.Y.

[ * ] Notice: The term of this patent shall not extend beyond the expiration date of Pat. No. 5,494,178.

[21] Appl. No.: 604,898

[22] Filed: Feb. 22, 1996

Related U.S. Application Data

[63] Continuation of Ser. No. 280,065, Jul. 25, 1994, Pat. No. 5,494,178.

[51] Int. Cl.[6] ..... A47F 5/00

[52] U.S. Cl. ..... 211/189; 211/87; 211/182; 52/509

[58] Field of Search ..... 211/189, 87, 182, 211/40, 41, 194; 40/124; 52/509, 49.1

[56] References Cited

U.S. PATENT DOCUMENTS

| | | | |
|---|---|---|---|
| 3,896,743 | 7/1975 | Pariente | 211/182 X |
| 3,961,453 | 6/1976 | Couwenbergs | 52/509 |
| 4,042,683 | 8/1977 | Kilian | 52/509 X |
| 4,493,425 | 1/1985 | Yoshida | 211/189 |
| 4,497,125 | 2/1985 | Hutchinson | 40/124 X |
| 4,515,280 | 5/1985 | Sheu | 211/189 |
| 4,673,152 | 6/1987 | Brown | 248/216.1 |
| 4,951,827 | 8/1990 | Moransais | 211/59.1 |
| 5,172,817 | 12/1992 | Gross | 211/182 X |

FOREIGN PATENT DOCUMENTS

| | | | |
|---|---|---|---|
| 2301169 | 7/1974 | Germany | 52/509 |

*Primary Examiner*—Robert W. Gibson, Jr.
*Attorney, Agent, or Firm*—Barry G. Magidoff, Esq.

[57] ABSTRACT

Display apparatus includes at least two longitudinally extending members for operation in a vertical position, including at least four panel holders with two each of the holders secured to each member. A panel is held at its corners by each holder to extend between the longitudinally extending members. The panel holders include a facing pair of substantially rigid plates having substantially flat opposing surfaces, a rigid member separating and interconnecting the plates, including dividing protrusions to divide the volume between the plates into segments. A clamping mechanism extends from one of the flat plates toward the other and moveably held in relation to the other plate to clamp in place any member held within the volume between the two plates.

12 Claims, 3 Drawing Sheets

DISPLAY AND DECORATIVE FIXTURE APPARATUS

This is a continuation of application Ser. No. 08/280,065 filed on Jul. 25, 1994 now U.S. Pat. No. 5,494,178.

BACKGROUND OF THE INVENTION

This device relates to a display or decorative system, especially adapted for use in retail store merchandise display units, or in the home. The devices of this invention more particularly provide a simple and inexpensive, yet highly effective means to provide support for substantially flat panels, or pictures, and in a related system to provide a system for displaying products or knickknacks from a horizontally extending support member.

PRIOR ART

Historically, panel surfaces have been displayed, or presented, as part of a relatively complex and difficult to assemble system comprising vertical columns, side members, individual connecting elements such as threaded screws or rivets or nails which had to be interconnected or disconnected in a complicated and time consuming manner, often requiring more than a single individual. To initially overcome the difficulties of the afore-stated conventional systems, other workers have presented means utilizing interconnecting pieces including panels which fit into and are supported by grooved members, which in turn are part of supporting substructure. One such grooved member in shown in U.S. Pat. No. 4,493,425 to Yoshida. Yoshida described a rather complex series of members which are used at different portions of an overall structure, i.e. at an end, at a middle or at corners, each unit being of a distinctly different type.

Another coupling device, which has been used for forming a display case, without a metal skeleton, is shown in U.S. Pat. No. 4,515,280 to Sheu.

A display rack, comprising two (2) opposing vertically extending surfaces having holes for the attachment of suspension shanks or hooks, has previously been shown for example by Moransais in U.S. Pat. No. 4,951,827. Although this rack is capable of displaying products from both sides, it requires a rather complex connecting means to produce the desired result, which distinguished it from the earlier classical type of display racks which are vertically extending surfaces providing for products to be hung from them and extending outwardly from only one side.

SUMMARY OF THE INVENTION

It is accordingly a general object of the invention to remedy the limitations of the prior art without providing an excessively complicated structure, and one which permits the construction of the desired system with a minimum of effort and preferably by a single individual.

The first part of the present invention is directed to panel holding means which can be supported from a vertical member and which in turn can support either vertically extending panels or horizontally extending panels. A combination of such panel holders on a plurality of vertical supports can be used to provide such panel surfaces over an extended area.

Most specifically, the panel holder of this invention comprises a pair of opposed substantially flat plates rigidly secured together at a defined distance by at least one rigid member; preferably, a plurality of rigid members are so distributed intermediate the flat plates that the plates do not tend to pivot relative one to the other, if they are pressed together at any point along their peripheries. The rigid members are further so juxtaposed as to permit entry between the flat elements of a corner of a panel, but preferably only to a limited degree, i.e., not passing the center of the holder, or contacting any centrally located element, so as to avoid contact of a corner of a panel with any solid element within the panel holder, and thus prevent damage to the corner.

In another aspect of this invention, a pair of panels, each having a plurality of orifices therethrough, are secured from a plurality of vertical members such that the orifices are in coaxial conjunction to permit a longitudinally extending member to pass through a hole in each of the panels successively and in a substantially horizontal direction. The longitudinally extending member can then by utilized as a support means for other items at either side of the panels.

A clearer understanding of the advantages of the elements of the present invention is exemplified, and can be best understood, from the accompanying drawings.

BRIEF DESCRIPTION OF THE DRAWINGS

The following drawings illustrate the preferred embodiments of the devices of the present invention, but are not intended to be exclusive thereof.

DETAILED DESCRIPTION OF PREFERRED EMBODIMENTS

Figure 5:
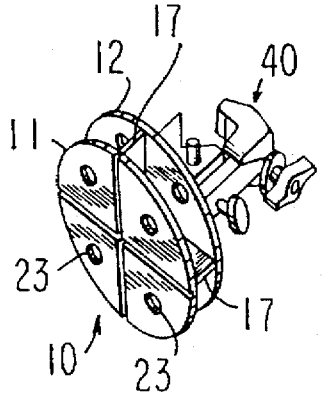
FIG. 5 is an isometric view of an alternative embodiment of the panel holder of this invention, including a clamping means for attachment to a vertical support column.
Figure 3:
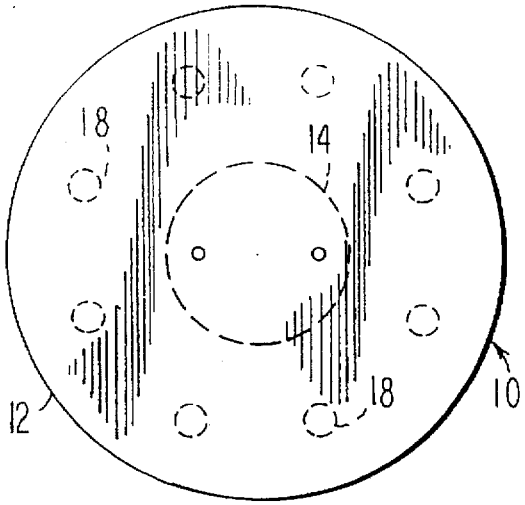
FIG. 3 is a rear elevation view of the panel holder of FIG. 2.
Figure 2:
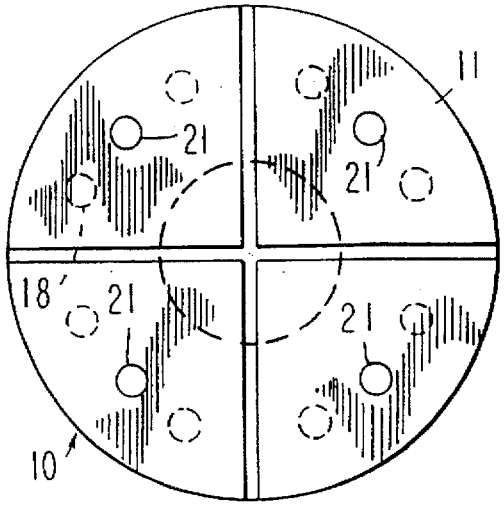
FIG. 2 is a front elevation view of a panel holder in accordance with the present invention.
Figure 4:
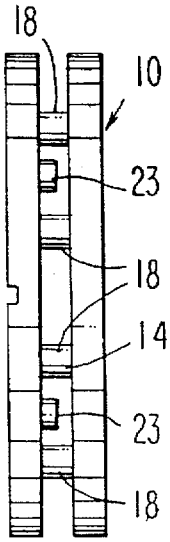
FIG. 4 is a side view of the panel holder of FIG. 2.

Referring to FIGS. 1–6, the panel holder, generally indicated by the numeral 10, comprises a pair of opposed members 11, 12, having substantially flat inner surfaces, and in the case shown having substantially flat outer surfaces as well. The opposed members 11, 12 are separated and connected by a central member 14, which may be integrally formed with one or both of the outer members 11, 12 and threadedly or otherwise connected to the other member. In addition, the opposed members are also separated and held at a designated distance, by the radially extending bars 17, which extend radially outwardly from the center member 14, as shown in FIG. 5, or by a plurality of transversely extending rod members 18, as shown in the embodiment of FIG. 4, the centers of which are juxtaposed as to lie in a concentric circle intermediate the outer edges of the opposed members 11, 12 and the central member 14.

Figure 6:
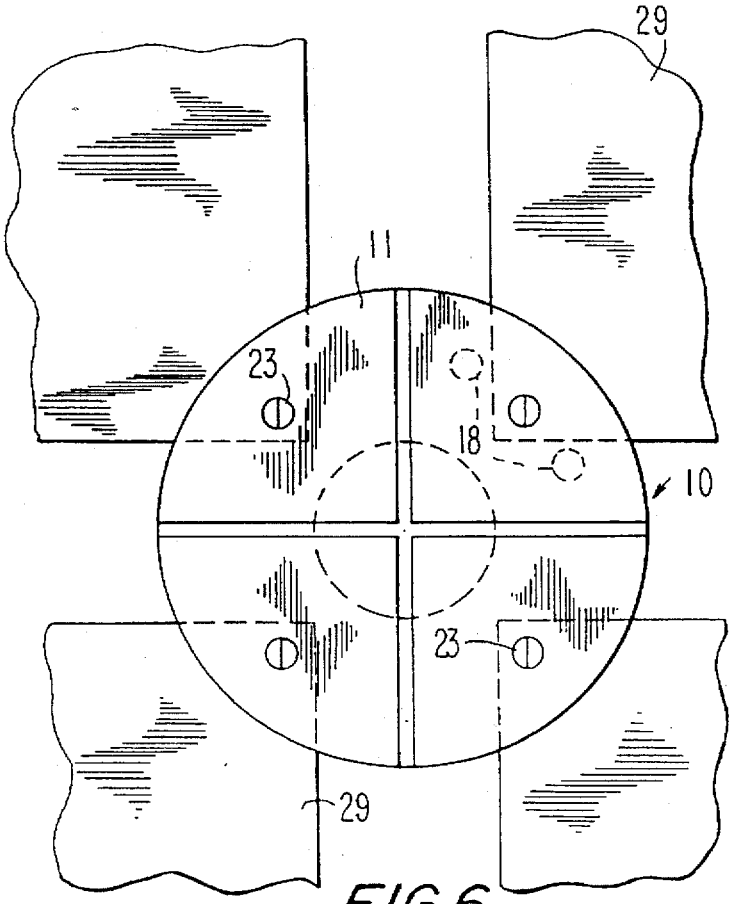
FIG. 6 is an enlarged view of a single panel holder from the overall schematic of FIG. 1, including portions of four panels.

Four threaded holes through the front member 11 are defined by internally threaded circumferences 21. A threaded stud 23 is releaseably secured through each of the four holes 21, as shown in FIGS. 4 and 6, movable transversely towards and away from the rear member 12.

A series of panel holders 10 can be secured to, for example, a pair of vertical post members, such as the floor-to-ceiling spring loaded member 30 by, for example, a clamp, generally indicated by the numeral 40 in FIG. 5, secured to the panel holder 10, or the panel holder can be, for example, directly bolted onto the vertical support means, via the rear member 12.

Figure 1:
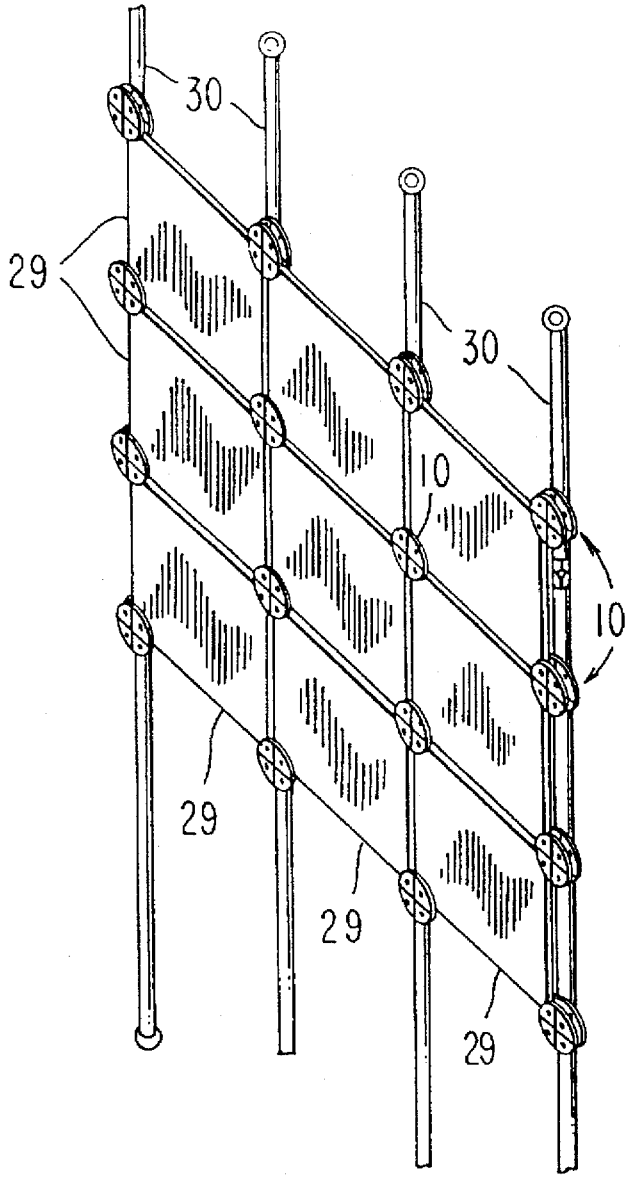
FIG. 1 is a schematic overview showing the devices of the present invention in isometric projection.

In operation, the panel holders are secured to a vertical post. Specifically, for example, the lowermost row of the panel holders 10, as shown in FIG. 1, are secured on the posts 30 and flat panels 29 are inserted, by each lower corner, into a quadrant of one of the panel holders 10. The quadrant is defined either by the radially extending bar members 17 or by the concentrically arranged post members 18. The holder members 11, 12 are separated by a gap greater than the thickness of the individual panels 9, and the panels are secured in place and prevented from transverse movement by being compressed, utilizing the threaded stud 23.

The upper corners of the first row of panels are then secured into the next level of panel holders 10 by moving the panel holders down over the corner of this first row, and the second row of panel holders are then tightened onto the vertical support members 30. This is then repeated by putting the bottom corners of a second row of panels into that second row of panel holders and then securing the top corners of this panels by a third row of panel holders, to form an array of panels, as shown, for example, in FIG. 1. In this manner, an entire wall of panels can be provided, of a variety of appearances, colors or shapes as desired to change the appearance of, or to provide different displays in, a particular location, without changing in any permanent fashion, the structure of that room.

As explained, in addition to being secured to the vertical posts 30 by a clamp 40, the panel holders can be directly secured onto the posts 30, or even directly onto a wall where the panels form a second wall as a means of varying the decor or appearance of a room.

Figure 9:
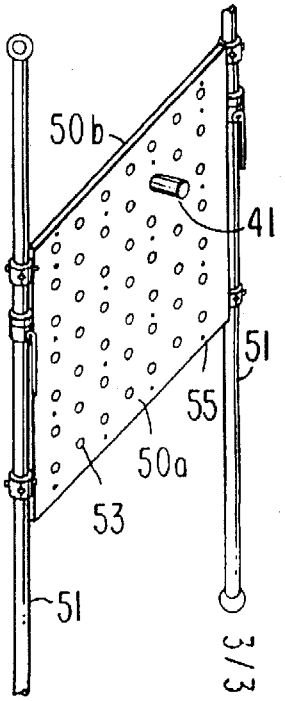
FIG. 9 is a side view of a support rod used for the sandwich support panel.
Figure 10:
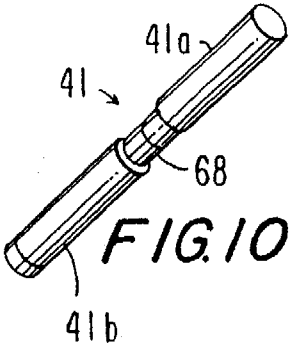
FIG. 10 is an isometric view showing several support rods in a sandwich support panel of the present invention.

The system can by further varied by utilizing two panel holders, back-to-back, surrounding, e.g., the posts 30 and threadedly connected together so as to be strongly clamped around the posts 30. In this way, the panel holders become self clamping with respect to their vertical support members and these panel holders can then be used to form the panel sandwiches of FIGS. 9 and 10.

Figure 7:
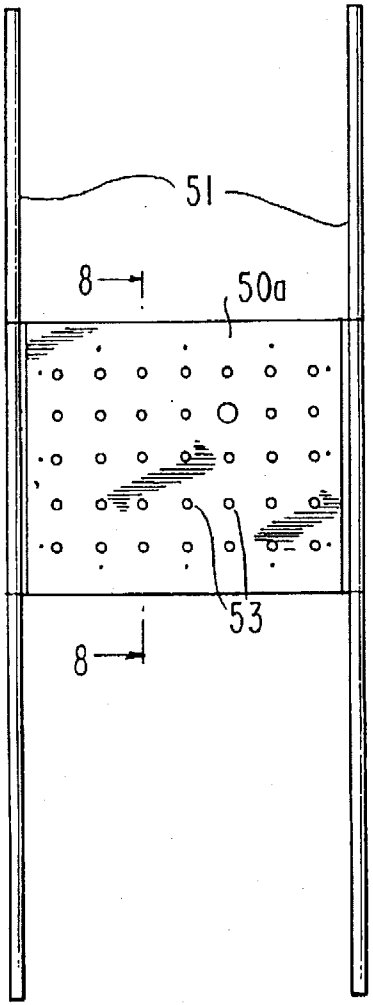
FIG. 7 is a front elevation view of the sandwich support panel of the present invention secured to a pair of vertical support posts.
Figure 8:
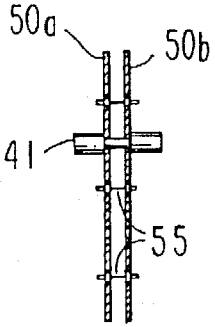
FIG. 8 is a cross-sectional elevation view taken along lines VIII-VII FIG. 7.

The support panel sandwich members of the present invention, as shown in FIGS. 7 and 8, comprise two substantially parallel panels substantially identical to each other 50*a*, 50*b*, each rigidly supported onto a pair of vertical support members 51 such as the AUTOPOLE set forth above. The two panel members 50*a, b* each have a pattern of holes formed therethrough 53, and the two panels 50*a, b* are juxtaposed such that the holes through the two panels are coaxially juxtaposed one with the other. In addition to being firmly held by the vertical support members 51, the panels 50*a, b* are also rigidly held together by lateral attachment means 55 extending between the two panels. These attachment means secure the panels together and assure that they are maintained at a constant separation. As described above, the two panels can be secured to the posts 51 by a pair of the afore-described panel holders, or they can be secured by a separate clamping means. It is noted that a sufficiently strong panel holder can hold directly only one of the pair of panels i.e. at each of its four corners, and the second panel can extend from, and be supported by, the first panel.

A horizontal support rod 41 extends through a pair of juxtaposed mating holes in the two panels 50*a, b*, and can be used to support articles from either side of the panel sandwich structure. In this manner, an extremely simple but secure means is provided for displaying merchandise, e.g., clothes on hangars, from two sides of a support panel, in a store context, or other decorative items in a domestic context.

The support rods 41 preferably are not completely cylindrical in shape, but are preferably narrower at a central portion 61 which, in use, extends between the outer surfaces of the two panel members. In this way, the horizontal rod 41 is held in place and prevented from sliding through the holes 53, thus maintaining a desired, length extending outwardly from each panel outer surface.

It is understood that although a cylindrical support rod is disclosed, the rod can have other cross-section shapes including a polygon, as well as other curved shapes, such as an oval cross-section. Where the panels are formed of a somewhat elastic material, by pressing the rod through the two panels, the panels will then more securely hold the rods in place. The support rod 41 can be formed as a single integral unit. Alternatively, the rod 41 can be formed as two halves 41*a, b*, threadedly or otherwise interconnected along the reduced diameter central portion 61, such that the two halves are each independently pressed through from the exterior surface of the panel and then interconnected between the panels, thus firmly securing the rod in place; this is especially effective where the diameter of the holes 53 are smaller than the diameter of the rod ends 41*a, b*.

The panels can be made of any substantially free-standing rigid material, preferably having a certain degree of elasticity, and sufficient structural strength to provide the needed support. The horizontal support rods are preferably a rigid material, including, without limitation, a metal, a rigid polymer, or wood or other material, allall being useful for the desired operation of the present invention.

The above description sets forth preferred embodiments of the present invention but are not to be taken as exclusive of their full scope. The invention is defined by the claims that follow.

I claim:

1. A display means comprising at least two longitudinally extending members designed to be maintained in operation in a vertical position; at least four panel holding means secured to the two longitudinally extending members, two of such panel holding means on each longitudinally extending member, and a panel, the corners of which are held by the panel holding means and which extends between the two longitudinally extending members; the panel holding means comprising a facing pair of rigid plates, each plate having a substantially flat surface, the flat surfaces being juxtaposed in parallel facing relationship, a rigid spacing member separating, and interconnecting, in a rigid manner, the two plates, dividing means to divide the volume between the two plates into segments, and clamping means extending from one of the flat plates towards the other plate and moveably held in relation thereto to clamp in place any member held within the volume between the two plates.

2. The display means of claim 1, wherein the dividing means comprises a plurality of bars extending radially outward from the rigid member and rigidly secured to the flat surface of at least one of the plates, and extending transversely substantially the complete distance to the second plate.

3. The display means of claim 1, wherein the dividing means comprises at least four rods extending transversely from, and rigidly secured to, the flat surface of at least one of the plates, and extending transversely substantially the complete distance to the second plate.

4. The display means of claim 1, wherein pairs of the panel holding means are held together around the longitudinally extending members, and a pair of panels are held by the paired panel holding means in close parallel relationship.

5. The display means of claim 4, wherein the pair of panels each define a series of holes which are so juxtaposed as to be coaxial, and further comprising at least one horizontal support rod extending through a juxtaposed pair of holes, tranversely outwardly from the two panels.

6. The display means of claim 5, wherein the horizontal support rod comprises first and second end portions having substantially constant cross-sections, and a central portion, intermediate the two end portions and having a substantially smaller cross-section.

7. The display means of claim 6, wherein the two rigid plates are removably interconnected, and comprise interconnection means located along the central portion.

8. A panel holder comprising a facing pair of rigid plates, each having an exterior surface and an opposed interior surface, the two interior surfaces being substantially flat and in a parallel facing relationship; a rigid spacing member separating, and interconnecting, in a rigid manner the two plates; dividing means to divide the volume between the two plates into segments; screw clamping means extending from one of the flat plates towards the other plate and moveably held in relation thereto to clamp in place any member held within the volume between the two plates, and support means for securing the panel holder to a vertical support member, and secured to one of the plates.

9. The panel holder of claim 8, wherein the dividing means comprises four bars extending radially outward from the rigid spacing member and rigidly secured to the internal surface of at least one of the rigid plates, and extending transversely substantially the complete distance to the second plate.

10. The panel holder of claim 8, wherein the dividing means comprise at least four rods extending transversely from, and rigidly secured to, the internal surface of at least one of the flat plates, and extending transversely substantially the complete distance to the second plate, the rods being located radially outward from the rigid spacing member and the axes of the rods lying along a concentric circle located intermediate the outer edges of the plates and said spacing member.

11. The panel holder of claim 8, wherein said rigid spacing member is centrally located relative said two flat surfaces of said rigid plates.

12. A display means comprising at least two longitudinally extending members; at least four panel holding means secured to the two longitudinally extending members, two of such panel holding means on each longitudinally extending member, and a panel, the corners of which are held by the panel holding means and which extends between the two longitudinally extending members; the panel holding means comprising a facing pair of substantially rigid plates, a rigid central member separating, and interconnecting, in a rigid manner the two plates, dividing means to divide the volume between the two plates into segments, and clamping means extending from one of the flat plates towards the other plate and moveably held in relation thereto to clamp in place any member held within the volume between the two plates.

* * * * *